United States Patent [19]

Shirasaka et al.

[11] 4,097,621

[45] Jun. 27, 1978

[54] METHOD FOR MANUFACTURING BIAS FABRIC

[75] Inventors: Kaname Shirasaka, Takatsuki; Yoshihiro Nakagami, Akashi; Takashi Tomiyori, Kobe; Masanori Ikemoto, Kobe; Tsuneo Shaura, Kobe, all of Japan

[73] Assignee: Mitsuboshi Belting Ltd., Kobe, Japan

[21] Appl. No.: 730,393

[22] Filed: Oct. 7, 1976

Related U.S. Application Data

[60] Division of Ser. No. 580,280, May 23, 1975, Pat. No. 4,034,702, which is a continuation-in-part of Ser. No. 404,566, Oct. 9, 1973, abandoned.

[30] Foreign Application Priority Data

Oct. 9, 1972 Japan ..... 47-101417

[51] Int. Cl.[2] ..... D06C 3/02

[52] U.S. Cl. ..... 427/173; 427/176; 28/157

[58] Field of Search ..... 26/51.3, 51.4, 52; 118/34; 28/74 R, 157; 427/173, 176

[56] References Cited

U.S. PATENT DOCUMENTS

| | | | |
|---|---|---|---|
| 34,960 | 4/1862 | Helm | 26/51.3 |
| 253,806 | 2/1882 | Woodman | 118/34 |
| 494,492 | 3/1893 | Schofield | 118/34 |
| 731,014 | 6/1903 | Bittner | 26/51.3 |
| 776,532 | 12/1904 | Morand | 118/34 |
| 848,416 | 3/1907 | Voland et al. | 26/51.3 |
| 1,763,569 | 6/1930 | Van Orman | 26/51.3 |
| 2,722,486 | 11/1955 | Thorp | 427/176 |
| 3,551,970 | 1/1971 | Cohn et al. | 26/51.3 X |
| 3,670,375 | 6/1972 | Cohn et al. | 26/51.3 |
| 3,832,210 | 8/1974 | Rohlfing | 427/176 |

FOREIGN PATENT DOCUMENTS

| | | | |
|---|---|---|---|
| 350,335 | 11/1905 | France | 26/52 |
| 183,987 | 4/1907 | Germany | 26/51.3 |
| 25,268 of | 1911 | United Kingdom | 26/51.3 |

*Primary Examiner*—Robert R. Mackey
*Attorney, Agent, or Firm*—Sughrue, Rothwell, Mion, Zinn and Macpeak

[57] ABSTRACT

A method is provided for manufacturing a bias fabric provided with characteristic physical properties by continuously varying the intersecting angle between the warp and the weft by a mechanical device. A fabric subjected to the process according to the invention can be any type of fabric woven on conventional looms such as satin, twill, plain and duplex fabrics. The principal part of the apparatus according to the invention is comprised of a fabric supplying device, a resin impregnating device to apply resin to a fabric for the purpose of fixing the bias structure produced by deforming the orthogonal structure of the original fabric, a heat setting oven to heat set the resin impregnated fabric, a pair of endless tenter chains provided with needle blocks to hold the fabric at the selvages, each of the endless tenter chains comprising an arched part whereby the intersecting angle between the warp and the weft is varied while the weft is maintained in the direction parallel with the original direction thus forming a bias structure, a device to release the fabric from the needle blocks and a take-up device to wind the bias fabric in a roll.

3 Claims, 8 Drawing Figures

FIG. 5
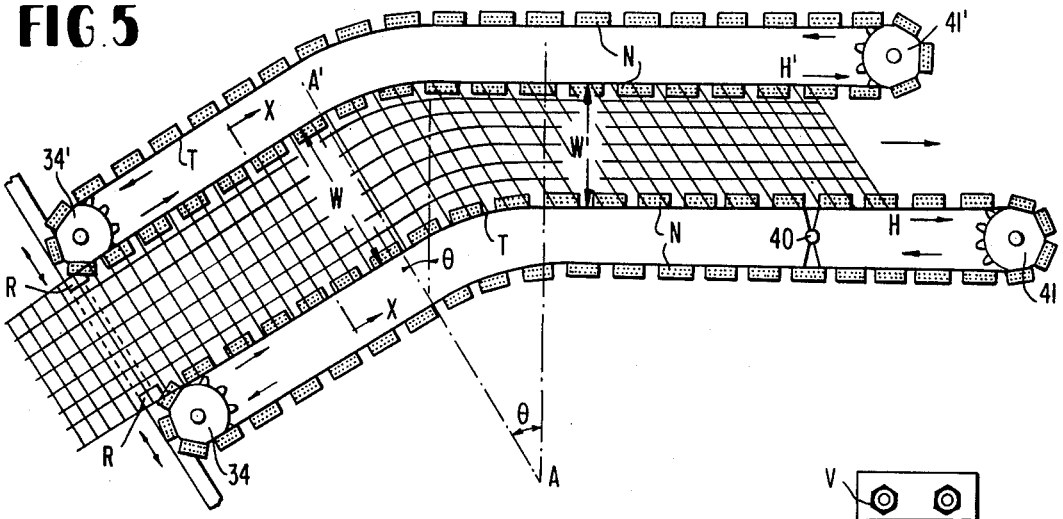
FIG. 6
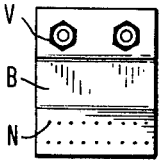
FIG. 7
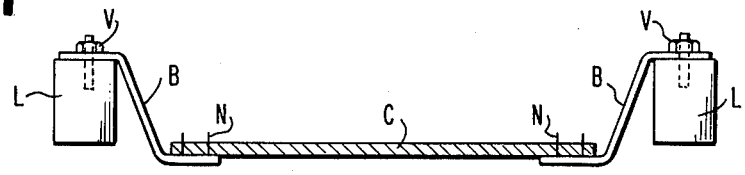
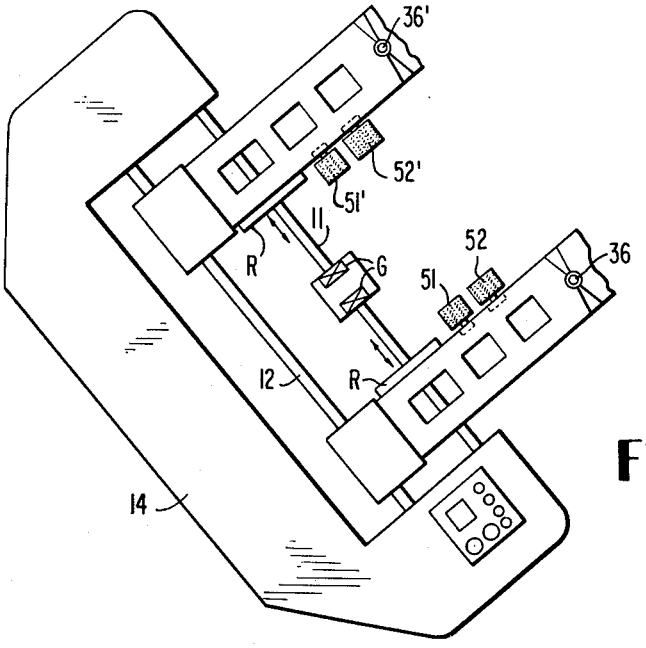
FIG. 8

METHOD FOR MANUFACTURING BIAS FABRIC

CROSS REFERENCE TO RELATED APPLICATION

This application is a division of application Ser. No. 580,280 filed May 23, 1975, now U.S. Pat. No. 4,034,702 granted July 12, 1977 which application is a continuation-in-part of application Ser. No. 404,566, filed Oct. 9, 1973, now abandoned.

BACKGROUND OF THE INVENTION

Woven fabric is used for versatile purposes. In some cases, a fabric is required to be stretchable beyond its original stretchability. Many methods have been introduced to produce a fabric that is available for those purposes. Among those conventional methods the most practical method requires that a fabric constructed with an orthogonal warp and weft structure be cut diagonally across the width to obtain a biased fabric. However, this method has the disadvantages that the fabric pieces diagonally cut are not sufficiently long enough for use thereby requiring that many pieces be pieced together to make a long biased fabric and that the selvages where warp density is high need to be removed to obtain a uniform property throughout the pieced bias fabric. Furthermore, an inevitable disadvantage is that although the fabric is cut on the bias, the stretchability is limited within a narrow range. In other methods, the weft is inserted diagonally across the width of fabric on a special loom or a hollow woven tubular fabric is cut open in a spiral and extended to deform the intersecting angle of warp and weft. However, those methods require special looms or devices and there is some inconvenience in applying them to practical production.

The advantage of the method according to the invention is that a running length of fabric is efficiently and continuously converted into a bias fabric.

Another advantage of the invention is that a bias fabric produced by the method according to the invention is provided with a feature that physical properties in each orthogonal direction are quite different from each other which is often important when the bias fabric is used as industrial material.

SUMMARY OF THE INVENTION

Accordingly, an object of the invention is to provide a method for manufacturing a bias fabric that is free of those disadvantages found in the bias fabric produced by the conventional methods. Another object of the invention is to provide a method whereby a fabric woven on a conventional loom is continuously converted into a bias fabric by changing the orthogonal warp and weft intersecting angle to an optional angle by mechanical deformation without varying the physical properties of the fabric with respect to the warp and weft directions. A bias fabric thus produced is provided with different physical properties for each of the two dimensions, the lengthwise and widthwise direction. The feature of the apparatus according to the invention is the provision of a novel pin tenter on which the angle at which the warp intersects the weft is changed while the weft is maintained in the original direction during the manufacturing procedure.

The apparatus according to the invention is to be provided with such devices that will satisfy the following conditions:

1. A pair of endless tenter chains curved in an angle corresponding to the fabric deformation angle to change the intersecting angle between warp and weft.

2. The curved sections of the endless tenter chains are installed at a position between the entrance and exit of the tentering section.

3. The curved section of each endless tenter chain is an arc of a circle of an equal arc length.

4. After the deformation of the fabric structure is completed at the exit of the curved section, both chains are arranged in parallel with each other.

5. Velocities of both endless tenter chains are equal to each other.

6. The lengths of both endless tenter chains are equal to each other.

7. The distance between the endless tenter chains is optionally adjustable according to the width of fabric required.

8. On the endless tenter chains, needle blocks are provided to hold a fabric at the selvages.

9. A width regulator at the entrance of the tentering section is provided to keep a fabric in a definite width.

10. A resin applying device is provided whereby the fabric is resin treated to fix the deformed structure.

11. An oven is provided to heat set the resin impregnated fabric to stabilize the deformed structure.

BRIEF DESCRIPTION OF THE DRAWINGS

FIG. 5 is a schematic plan view of a fabric holding device showing the principle of the deformation mechanism.

FIG. 6 is a detailed plan view of a needle block for holding a fabric.

FIG. 7 is a cross sectional view taken along the line X—X in FIG. 5 showing a fabric tentered between a pair of endless tenter chains.

FIG. 8 is a detailed view of the lefthand end of the apparatus shown in FIG. 3.

DETAILED DESCRIPTION OF THE PREFERRED EMBODIMENT

Figure 3:
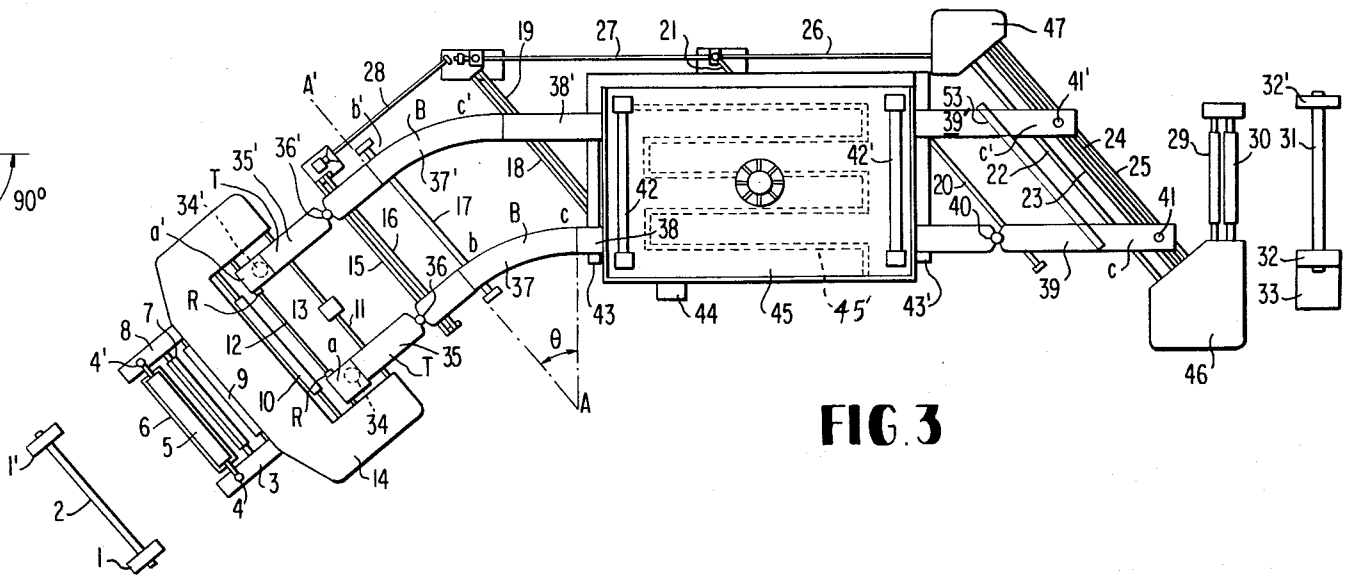
FIG. 3 is a general plan view of an apparatus of the invention.
Figure 4:
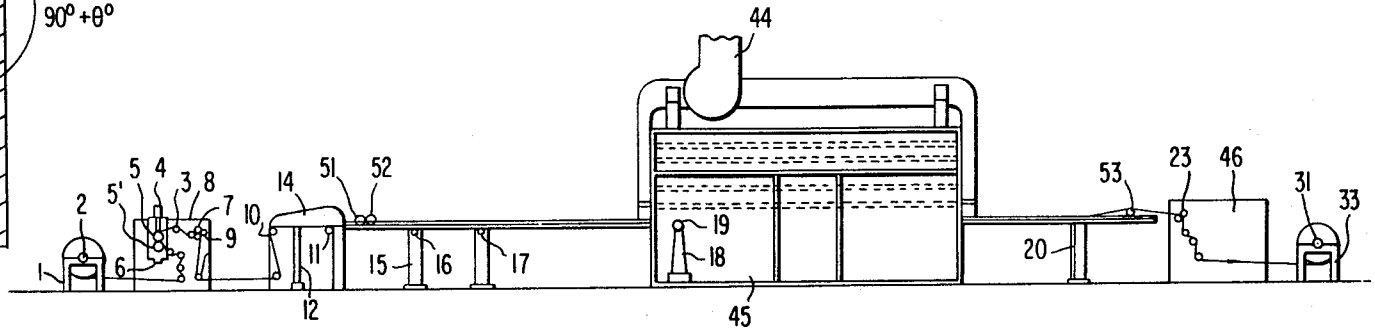
FIG. 4 is a side elevation of an apparatus of the invention.
Figure 1:
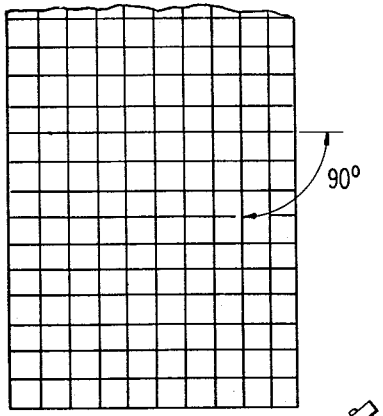
FIG. 1 represents a plain weave fabric wherein warp and weft are intersecting orthogonally with each other.
Figure 2:
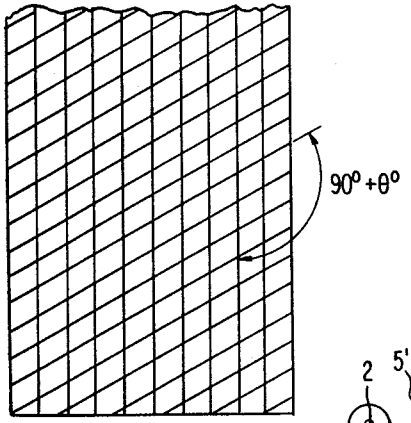
FIG. 2 represents the fabric in FIG. 1 after deformation.

Referring to FIGS. 3 and 4, a roll of plain weave canvas is placed on a shaft 2 of a feed stand 1 and 1'. The canvas is properly impregnated with a thermosetting resin by passage between a press roller 5 and a transfer roller 5' which is half immersed in a resin vat 6. Pressure for the press roller 5 is adjusted by a set of pressure adjusting devices 4 and 4'. After resin treatment, the canvas is delivered to the tenter section through tension adjusting rollers 7, 9 and guide rollers 10 and 11. A central control box 14 comprises a complete set of regulators for the tenter chain operation. The space between a pair of endless tenter chains T—T is adjusted by rotating screw shafts 16, 19, 21 and 24 whereby chain guiding rollers engaged with said screw shafts are moved along rails 12, 15, 17, 18, 20 and 23. The initial part of the tenter chain supporting rails 35 and 35' are capable of swinging around pins 36 and 36' respectively along the rail 12 independently of the rest of the tenter chain supporting rails. Adjacent to sprockets 34 and 34' there are provided fabric width regulators R—R which slightly change the weft intersecting angle with the warp at the beginning of tentering process to keep the canvas a definite width. The curved part of the tenter chain supporting rails 37 and 37' and the straight part of the tenter chain supporting rails 38, 38', 39 and 39' are moved simultaneously by power units 46 and 47 through power transmitting shafts 22, 26, 27 and 28. The take-up head is comprised of a delivery roller 29, a guide roller 30, take-up shaft 31, take-up shaft supporting frames 32 and 32' and a motor 33. The tenter chains T—T are driven by driving sprockets 41 and 41' which are driven by a driving shaft 25 through bevel gears fixed to the sprockets 41 and 41' and to the driving shaft 25, respectively. The tenter chain supporting rail 39 is capable of swinging around a pin 40 in the same manner as the tenter chain supporting rails 35 and 35' so as to be able to bring the sprocket 41 to the desired position to adjust the takeup width of the canvas. The thermosetting resin impregnated canvas is heated in an oven 45 by steam ducts 45', hot air ducts 42, 42', 43 and 43' and an exhaust fan 44 to fix and stabilize the warp and weft structure after deformation.

The fabric deformation process will be explained by referring to FIGS. 5, 6 and 7. The thermosetting resin impregnated canvas C is held at the selvages by needles N of needle blocks B which are fixed to the chains L by bolts V. A pair of endless tenter chains on both sides of the canvas are driven at the same velocity in the direction shown by arrows in FIG. 5. The initial canvas width is regulated to be a desired dimension by the regulators R—R through driving means G. Rotary pinning brushes 51, 51' and 52, 52' press the canvas down onto the needles so that the canvas is firmly held by the needles N. Thus held by the needles, the canvas is advance according to the movement of the endless tenter chains without changing the intersecting angle of warp and weft until the needle blocks reach the curved section of the tenter chain supporting rails where the warp direction is changed while the weft is kept in the original direction as both selvages of the canvas are advanced at the same velocity, the intersecting angle of warp and weft is deformed $\theta°$, the angle equivalent to the center angle of the arc of the tenter chain supporting rail, that is, the angle of warp direction change, so that the intersecting angle of warp and weft, which originally is orthogonal, becomes $90° + \theta°$, and therefore, the original width W of the canvas is narrowed to $W' = W \times \cos \theta°$. The arc of each tenter chain supporting rail has a radius which is at least equal to the original width W of the canvas. As best seen in FIG. 5, the radius of curvature of each arc is greater than the original width W of the canvas. In this way the change of direction of the warp is gradual enough to prevent wrinkling or bunching of the canvas.

In order to fix the deformed structure, the canvas is heated in the oven 45 by means of circulating hot air having a temperature of 100°-200° C to heat set the thermosetting resin. At the final stage of the tentering procedure, the width of the canvas is adjusted by moving the tenter chain supporting rail 39 around the pin 40 to control the take-up width of the canvas. The canvas is released from the tenter needles by a releasing rod 53 provided diagonally across the width of the canvas and then delivered by the delivery roller 29 and the guide roller 30 to the take-up shaft 31 (FIG. 3). Thus, the orthogonal structure of warp and weft is biased and the canvas is provided with dimensionally different stretchability.

The method for holding the selvages of a fabric is not restricted to the needle blocks as employed in the preferred embodiment. In modifications, a fabric can be held by such means as clips, a needle belt or any other gripping means. The deformation angle $\theta°$, that is the center angle of the arc of the tenter chain supporting rail, is practically invariable as the change of the center angle of the arc requires a total change in the installation of the related devices of the apparatus. The dimension of the arc will be determined in designing the apparatus according to the properties of the textile material.

As for the effect of moisture on deformation, it is a fact that, in general, deformation stress becomes lower when a fabric is subjected to deformation in the wet state. However, in the case of such a material as rayon, that swells upon wetting, it is recommended that the fabric be deformed prior to resin treatment and wetting. In order to attain more effectual heat setting, a preliminary dryer can be installed before the oven and it is also desirable to install a heat setting device after the oven in order to perfectly stabilize a synthetic fabric.

The features of the apparatus according to the invention are, as explained above, that a fabric constructed of orthogonal warp and weft structure, which is woven on a conventional loom, is continuously and efficiently converted into a bias fabric by changing the direction of warp while weft is maintained in the original direction; that the fabric is impregnated with thermosetting resin prior to deformation at the curved section of the tenter chains; that the width of the fabric is regulated by adjusting the space between the pair of endless tenter chains; and that thermosetting resin impregnated and deformed fabric is then heated in the oven to fix the bias structure by heat setting the thermosetting resin.

We claim:

1. A method for manufacturing a bias fabric comprising supplying a continuous running length of fabric having an initial width and orthogonally disposed warp and weft, gripping the opposed edges of said running length, feeding said fabric along a first straight path, changing the direction of said running length by moving opposite edges of said fabric simultaneously along identical spaced apart curved paths of equal arc length having radii greater than said initial width and disposed in the plane of said fabric to change the direction of the warp while maintaining the weft in the same direction and while preventing wrinkling or bunching of the fabric, maintaining said fabric at its predetermined width prior to changing the direction, feeding said fabric in a new direction along a second straight path subsequent to changing the direction, releasing the opposed edges of said running length of fabric diagonally of the second straight path and taking up said fabric.

2. A method as set forth in claim 1 further comprising impregnating said fabric with a heat setting resin and applying heat to said fabric prior to release to set the bias in the fabric.

3. A method as set forth in claim 2 wherein said impregnating is prior to imparting a bias to the fabric.

* * * * *